US008079856B2

(12) United States Patent
Xiong

(10) Patent No.: US 8,079,856 B2
(45) Date of Patent: Dec. 20, 2011

(54) ROTATABLE POWER CONNECTOR

(75) Inventor: Kai-Chun Xiong, Shenzhen (CN)

(73) Assignees: Hong Fu Jin Precision Industry (ShenZhen) Co., Ltd., Shenzhen, Guangdong Province (TW); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 297 days.

(21) Appl. No.: 12/423,819

(22) Filed: Apr. 15, 2009

(65) Prior Publication Data

US 2010/0075518 A1 Mar. 25, 2010

(30) Foreign Application Priority Data

Sep. 24, 2008 (CN) ..... 2008 1 0304633

(51) Int. Cl.
*H01R 13/44* (2006.01)

(52) U.S. Cl. ..... 439/142; 439/188

(58) Field of Classification Search ..... 439/142, 439/188; 200/51.09, 51.1
See application file for complete search history.

(56) References Cited

U.S. PATENT DOCUMENTS 5,909,063 A * 6/1999 Silliman et al. ..... 307/112
6,290,520 B2 * 9/2001 Otsu ..... 439/188
2005/0245104 A1 * 11/2005 Nakagawa et al. ..... 439/63

* cited by examiner

*Primary Examiner* — Vanessa Girardi
(74) *Attorney, Agent, or Firm* — Raymond J. Chew

(57) ABSTRACT

A power connector includes a socket, an insulating member, a handle, a plug, and a blocking plate mounted between the handle and the insulating member to limit movement of the insulating member. The insulating member is received in the socket and includes a first through hole extending therethrough and an opening communicating with the first through hole. The handle includes a second through hole for receiving a part of the insulating member and with a diameter thereof being less than an outer diameter of the part of the insulating member so that the insulating member can rotate with the handle. The plug includes an end portion and an inserting portion received in the first through hole. Rotation of the handle with the insulating member relative to the socket either allows or disallows an electrical connection to be established between the socket and the inserting portion via the opening.

14 Claims, 4 Drawing Sheets

ROTATABLE POWER CONNECTOR

BACKGROUND

1. Technical Field

The present disclosure generally relates to a power connector.

2. Description of Related Art

In electronic devices such as desktop computers, servers, Internet appliances, for example, a power connector is required to electrically connect to a power supply device to provide power to the electronic device. A frequently used electronic device includes a printed circuit board (PCB) electrically connected to the power connector and including a plurality of controls to open or close the power connector. However, production cost of the electronic device is increased by the requirement for multiple controls, and efforts toward minimizing device profile are compromised.

Therefore, a need exists in the industry to overcome the described limitations.

DETAILED DESCRIPTION

Figure 1:
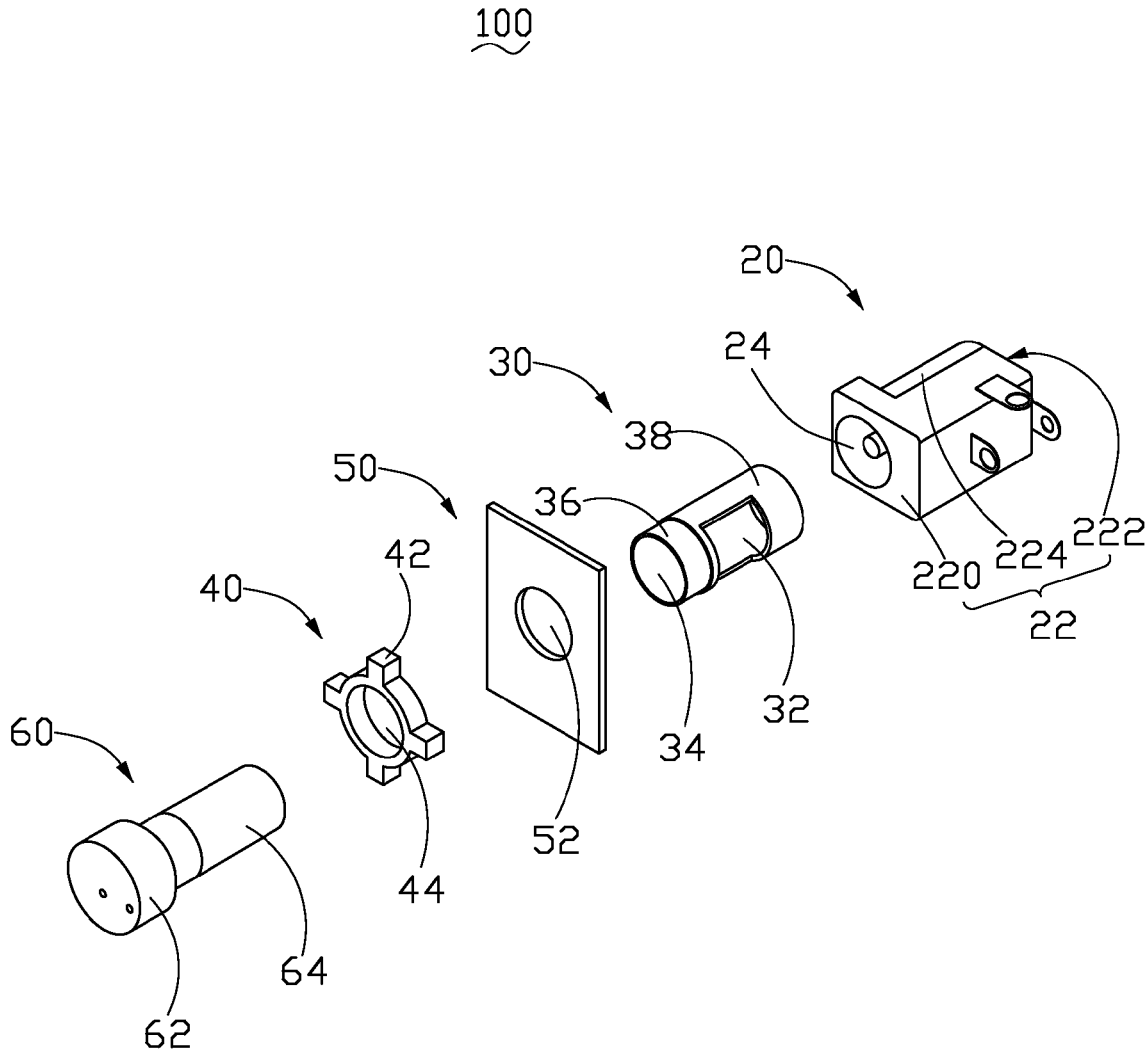
FIG. 1 is an exploded, isometric view of a power connector of an exemplary embodiment of the disclosure.

FIG. 1 is an exploded, isometric view of a power connector 100 of an exemplary embodiment of the present disclosure. The power connector 100 includes a socket 20, an insulating member 30, a handle 40, a blocking plate 50, and a plug 60 electrically connected to the socket 20.

The socket 20 is disposed on a circuit board (not shown) and provides power to the circuit board. The socket 20 includes an insulated enclosure 22, a receiving space 24, and a conductive pin 26 (referring to FIG. 3). In the illustrated embodiment, the enclosure 22 is substantially rectangular although it will be understood that other configurations may be utilized with equal applicability. The enclosure 22 includes a main body 224, a first end surface 220, and a second end surface 222 opposite to the first end surface 220.

The receiving space 24 extends from the first end surface 220 of the enclosure 22 toward the second end surface 222. The pin 26 embeds in the main body 224 of the enclosure 20 and projects into the receiving space 24 (referring to FIG. 3).

The insulating member 30 is made of an insulating material and received in the receiving space 24. The insulating member 30 includes a contact portion 36, a receiving portion 38 received in the receiving space 24, an opening 32, and a first through hole 34 communicating with the opening 32 and extending therethrough. An outer diameter of the contact portion 36 is slightly less than an outer diameter of the receiving portion 38. The opening 32 is defined at a bottom of the receiving portion 38 and adjacent to the contact portion 36.

Alternatively an outer diameter of the contact portion 36 is equal to an outer diameter of the receiving portion 38, that is, the insulating member 30 may not comprise the contact portion 36.

The handle 40 includes a plurality of projections 42 spaced from each other to conveniently operate the handle 40 and a second through hole 44. A diameter of the second through hole 44 is slightly less than the outer diameter of the contact portion 36. In other words, the second through hole 44 is sized to fit by interference with an outer surface of the contact portion 36 of the insulating member 30, rendering the insulating member 30 rotatable with the handle 40.

The blocking plate 50 is mounted between the handle 40 and the insulating member 30 and fixed on the circuit board to limit horizontal movement of the insulating member 30. The blocking plate 50 includes a hole 52 with a diameter thereof being slightly greater than the outer diameter of the contact portion 36 of the insulating member 30.

The plug 60 includes an inserting portion 64 and an insulated end portion 62. The inserting portion 64 is made of metal or other conductive material. An outer diameter of the inserting portion 64 is slightly less than a diameter of the first through hole 34 of the insulating member 30.

Figure 2:
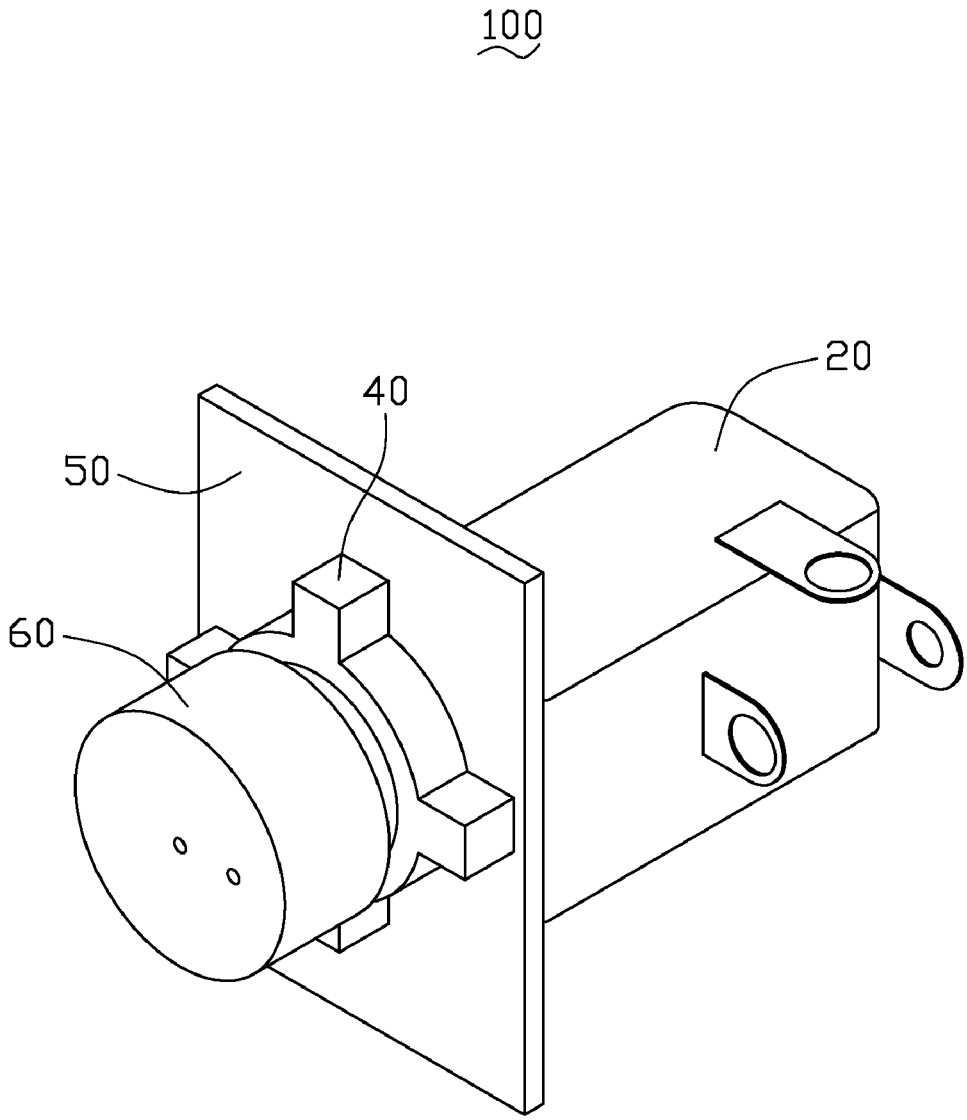
FIG. 2 is an assembled view of FIG. 1.

Referring to FIGS. 1-2, in assembly, the receiving portion 38 of the insulating member 30 is received in the receiving space 24 of the socket 20. The contact portion 36 extends through the holes 52 of the blocking plate 50 and is fixed in the second through hole 44 of the handle 40. The inserting portion 64 of the plug 60 is received in the first through hole 34 of the insulating member 30 through the second through hole 44 and the hole 52, thus the socket 20, the insulating member 30, the handle 40, the blocking plate 50, and the plug 60 are assembled in the power connector 100.

Figure 3:
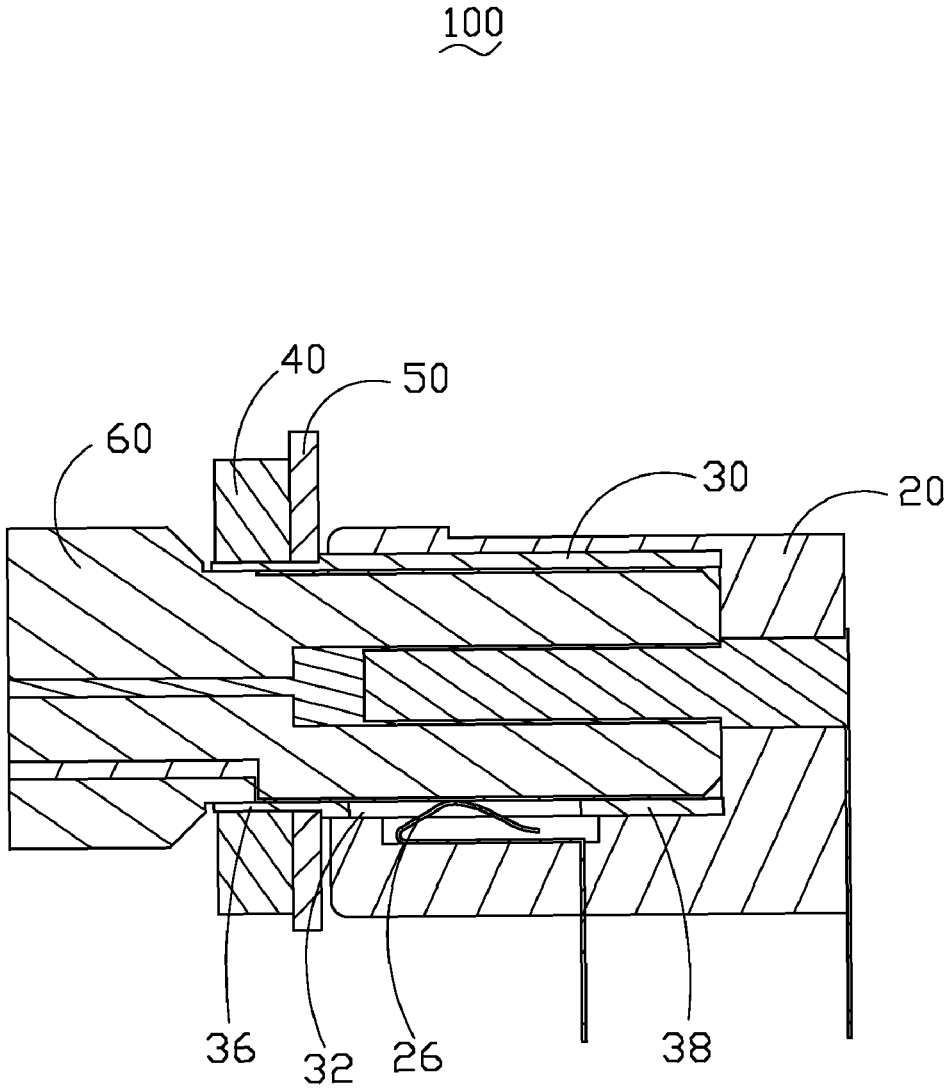
FIG. 3 is an assembled cross-section of FIG. 1, showing the power connector in an open position.
Figure 4:
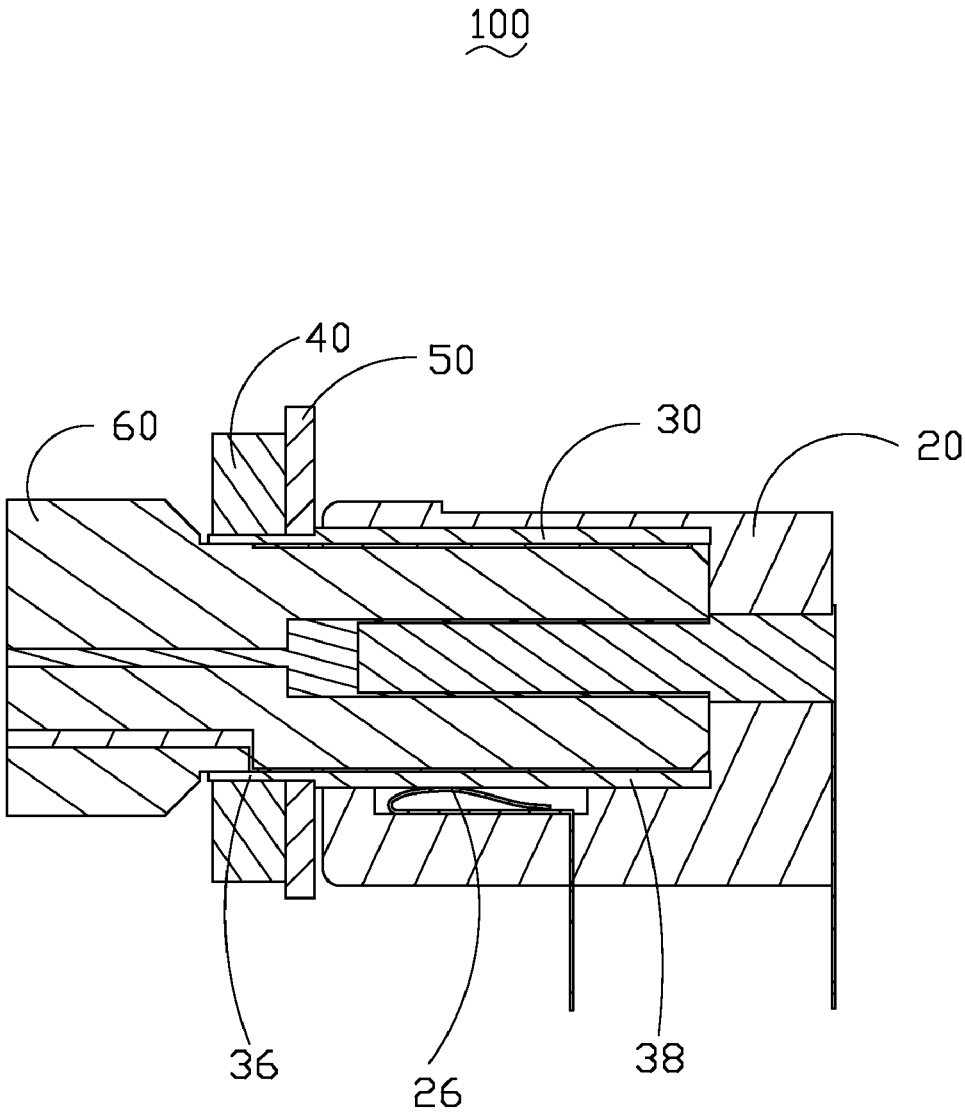
FIG. 4 is similar to FIG. 3, showing the power connector in a closed position.

FIG. 3 is an assembled cross-section of the power connector 100 in an open position. FIG. 4 is an assembled cross-section of the power connector 100 in a closed position. In use, the handle 40 is rotated relative to the socket 20 with the insulating member 30 rotatable relative to the socket 30 so that the pin 26 extends through the opening 32 into the first through hole 34 of the insulating member 30 to electrically connect to the inserting portion 64 (referring to FIG. 1), resulting in opening the power connector 100. In the open position, the power connector 100 provides power to the circuit board. Upon rotation of the insulating member 30 and the handle 50 the pin 26 and the inserting portion 64 are insulated by the receiving portion 38 of the insulating member 30, and the power connector 100 is closed. In the closed position, the power connector 100 cannot provide power to the circuit board. In other words, rotation of the handle with the insulating member relative to the socket either allows or disallows an electrical connection to be established between the pin of the socket and the inserting portion of the plug via the opening of the insulating member, thereby opening or closing the power connector.

Because rotation of the handle 50 can open or close the power connector 100, the circuit board requires no additional structure or elements to open or close the power connector 100, with the desired simplification of circuit design and reduction of production cost of the circuit board being achieved.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A power connector comprising:

a socket comprising an enclosure, a receiving space defined in the enclosure, and a conductive pin embedded in the enclosure and projecting into the receiving space;

an insulating member comprising a contact portion, a first through hole, an opening communicating with the first through hole, and a receiving portion received in the receiving space, wherein the first through hole extends through the contact portion and the receiving portion;

a handle comprising a second through hole for receiving the contact portion of the insulating member, wherein the second through hole is sized to fit by interference with an outer surface of the contact portion of the insulating member, so as to allow the insulating member to be rotatable in either an open position or a closed position with the handle;

a plug comprising an end portion and an inserting portion received in the first through hole through the second through hole; and a blocking plate mounted between the handle and the insulating member to limit movement of the insulating member;

wherein rotation of the handle with the insulating member relative to the socket in the open position allows an electrical connection between the conductive pin and the inserting portion of the plug via the opening of the insulating member, and wherein rotation of the handle with the insulating member relative to the socket in the closed position closes the electrical connection between the conductive pin and the inserting portion of the plug via the opening of the insulating member.

2. The power connector as recited in claim 1, wherein the handle comprises a plurality of projections spaced from each other to operate the handle.

3. The power connector as recited in claim 1, wherein an outer diameter of the contact portion is less than an outer diameter of the receiving portion.

4. The power connector as recited in claim 3, wherein the opening of the insulating member is defined at a bottom of the receiving portion and adjacent to the contact portion.

5. The electronic device as recited in claim 1, wherein the end portion of the plug is made of an insulating material.

6. The electronic device as recited in claim 5, wherein the inserting portion is made of a conductive material.

7. A power connector comprising:

a socket;

an insulating member comprising a contact portion, a first through hole, an opening communicating with the first through hole, and a receiving portion received in the socket, wherein the first through hole extends through the contact portion and the receiving portion;

a handle comprising a second through hole for receiving the contact portion of the insulating member, wherein the second through hole is sized to fit by interference with an outer surface of the contact portion of the insulating member, so as to allow the insulating member to be rotatable in an open position and a closed position with the handle;

a plug comprising an end portion and an inserting portion received in the first through hole through the second through hole; and a blocking plate mounted between the handle and the insulating member to limit movement of the insulating member;

wherein rotation of the handle with the insulating member relative to the socket in the open position allows an electrical connection between the socket and the inserting portion of the plug via the opening of the insulating member, and wherein rotation of the handle with the insulating member relative to the socket in the closed position closes the electrical connection between the socket and the inserting portion of the plug via the opening of the insulating member.

8. The power connector as recited in claim 7, wherein the handle comprises a plurality of projections spaced from each other to operate the handle.

9. The power connector as recited in claim 7, wherein an outer diameter of the contact portion is less than an outer diameter of the receiving portion.

10. The power connector as recited in claim 9, wherein the opening of the insulating member is defined at a bottom of the receiving portion and adjacent to the contact portion.

11. The electronic device as recited in claim 7, wherein the end portion of the plug is made of an insulating material.

12. The electronic device as recited in claim 11, wherein the inserting portion is made of a conductive material.

13. The electronic device as recited in claim 7, wherein the socket comprises an enclosure, a receiving space defined in the enclosure, and a conductive pin embedded in the enclosure and projecting into the receiving space, and wherein the receiving portion of the insulating member is received in the receiving space.

14. The electronic device as recited in claim 13, wherein the socket is electrically connected to the plug via an electrical connection between the pin of the socket and the inserting portion of the plug.

* * * * *